United States Patent [19]

Nordeen

[11] Patent Number: 5,052,623

[45] Date of Patent: Oct. 1, 1991

[54] COMPARTMENTALIZED PAINT CUP WITH SELECTOR VALVE FOR SPRAY GUNS

[76] Inventor: Melvin A. Nordeen, 11053 Stout La., Coulterville, Calif. 95311

[21] Appl. No.: 579,800

[22] Filed: Sep. 10, 1990

[51] Int. Cl.[5] ..... A62C 31/00; B05B 7/30

[52] U.S. Cl. ..... 239/305; 239/318

[58] Field of Search ..... 239/302-305, 239/318, 373, 289, DIG. 14

[56] References Cited

U.S. PATENT DOCUMENTS

| | | | |
|---|---|---|---|
| 1,090,863 | 3/1914 | Kelley | 239/305 |
| 1,774,694 | 9/1930 | Bateman | 239/305 |
| 1,948,401 | 2/1934 | Smith et al. | 239/305 |
| 2,339,379 | 1/1944 | Cook | 239/305 |
| 2,495,587 | 1/1950 | Magowan | 239/305 |

FOREIGN PATENT DOCUMENTS

| | | | |
|---|---|---|---|
| 318264 | 2/1957 | Italy | 239/305 |
| 1359439 | 7/1974 | United Kingdom | 239/318 |

*Primary Examiner*—Andres Kashnikow
*Assistant Examiner*—Lesley D. Morris
*Attorney, Agent, or Firm*—Basil Travis

[57] ABSTRACT

A paint cup with at least two vertical compartments is disclosed with complimentary aspirator tubes extending upwardly therefrom and through the proximate center of a detachable lid and into a selector valve housing to which a conventional spray gun may be attached for selective application of different materials by merely changing the position of a triangular gate spool valve.

1 Claim, 4 Drawing Sheets

COMPARTMENTALIZED PAINT CUP WITH SELECTOR VALVE FOR SPRAY GUNS

BACKGROUND OF THE INVENTION

My invention relates to a compartmentalized paint cup for use with a conventional spray gun. More particularly, my invention pertains to a compartmentalized paint cup detachably connected to a selector valve assembly by a plurality of aspirator tubes whereby an operator of a spray gun may select between different liquids in the paint cup for spray application by merely changing position of the valve. In its narrowest embodiment my new paint cup comprises two separate compartments, however in its broadest embodiment my new invention is a multi-chambered paint cup for alternate and individual application of several different liquid coatings with the same spray gun by merely moving a selector valve.

A review of the prior art discloses several paint cups for use with a conventional spray gun but none are compartmentalized. Therefore, the present state of the art requires that an operator of a conventional spray gun use a separate paint cup for each individual coating application. For example, in some commercial painting operations it is not uncommon to find several spray guns in use to accomplish a single task because each spray gun is limited to a single coating application. In automobile painting especially it is necessary to apply a surface material called a primer or prime coat which is of different chemical composition than the second or subsequent coating of paint. Often times more than one primer coating is required before the final coating of paint. And in other cases an additional coating of material called a sealer coating is applied over the final coating of paint to protect it. Thus, it is easily seen that a compartmentalized paint cup would provide a definite improvement over the prior art because it would permit the application of several surface coatings with a single conventional spray gun.

As it is perhaps well known, paint sprayers or spray guns as they are commonly called are a very important tool because they are incredibly fast and as much as ten times faster than painting with a brush. But most important paint spray guns produce a smooth and uniform coating which is ideal for painting automobile bodies, machinery and appliances. Typically, spray guns are either pressure fed or siphon fed by an air compressor. In pressure fed guns air is fed directly into the paint cup which forces paint up a tube and through the nozzle. The pressure fed gun is said to be best for application of heavy materials like latex paints or for fast spraying. The siphon fed gun is most commoly used today wherein air is supplied directly across an opening above an aspirator tube causing a vacuum, and atmospheric pressure entering the cup through a vent pushes the paint up into the nozzle of the gun. Thus, siphon fed guns are said to produce finer atomization and are best utilized when an extra fine finish is desired. However, either type of spray gun has heretofore been limited to the single application of a particular coating material in the paint cup.

Accordingly, it is the general object of the present invention to provide a compartmentalized paint cup with selector valve apparatus for use with either pressure fed or siphon fed spray guns enabling the operator to select different liquid surface coating materials for application by the spray gun by merely changing a valve position. This objective is achieved in the description, drawing and claims that follow herein.

SUMMARY OF THE INVENTION

With the foregoing in mind, the present invention provides an essentially cylindrical paint cup containing at least one additional vertical cylinder of equal height and forming at least two separate compartments inside the paint cup. A detachable air tight closure means or lid including at least two aspirator tubes extending downwardly into each respective compartment of the cup from a valve housing at the top of the lid for connection to a conventional spray gun and said housing also contains a rotatable valve spool for selectively opening and closing an inlet passageway in the valve housing between a respective aspirator tube and the spray gun.

In its most basic operation the compartmentalized paint cup is filled with two different kinds of paint, for example, a prime coat in the smaller inner vertical cylinder and a final coat in the larger outer cylinder. The bottom of the detachable lid contains a gasket which engages the circular rims of each cylindrical compartment so that when the lid is attached to the paint cup an air tight seal separates one compartment from another to prevent any mixing of the paints in the cup. The two aspirator tubes which are rigidly affixed through the center of the lid upwardly into a valve housing and downwardly nearly to the bottom of their respective compartments provide the means for transferring the paint to the spray gun. In siphon fed guns a vacuun is created above the valve housing in the spray gun which siphons paint from an individual compartment in accordance with the position of the selector valve spool defining an open passageway between a particular aspirator tube and the spray gun. A vent in the lid above each individual compartment provides the means for atmospheric pressure to enter the cup as paint is removed. In pressure fed guns these vents provide the means for pressurization of individual compartments.

The major advantage of the present invention over the prior art is that now a single conventional spray gun may be used for a variety of continuous tasks in a single operation.

DESCRIPTION OF THE PREFERRED EMBODIMENT

Figure 1:
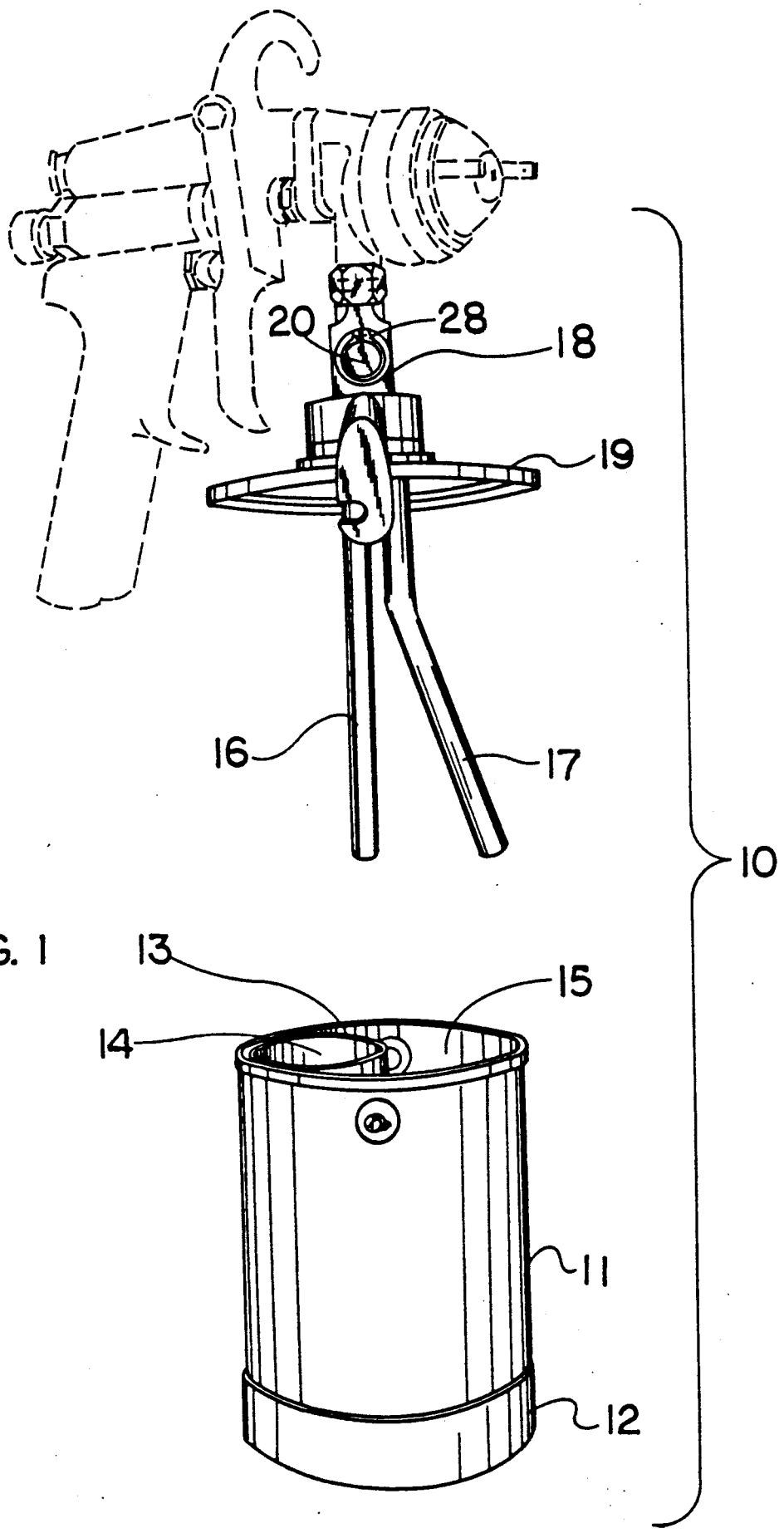
FIG. 1 is an exploded side elevational view the the present invention showing a conventional spray gun in broken lines.

Referring now to the drawings, the reference numeral 10 used throughout generally designates the compartmentalized paint cup with selector valve assembly of the present invention, however it should be understood at the outset that more than two compartments with a complimentary number of aspirator tubes and valve spool passages could have as well been illustrated as the preferred embodiment, as could also several varieties of conventional spray guns and connections in broken lines been illustrated, but for simplicity and ease of explaining and understanding the principal of the present invention a dual compartmentalized paint cup with assembly for a common siphon-type spray gun shall be utilized in the illustrations.

FIG. 1 is an exploded view of my new compartmentalized paint cup and selector valve assembly broken apart vertically. The paint cup wall 11 is basically a hollow cylinder sealed at the bottom by a circular cap 12. A second hollow cylinder 13 of equal length to the cup's interior vertical wall is permanently held in place against said wall by welding or other commomn types of adhesive material resistant to paint at the bottom of the paint can thereby forming a seal between the two illustrated vertical compartments 14 and 15. Although the preferred embodiment of my invention utilizes metal as its composition, it is also possible to make the cup fsrom other materials such as plastic where the compartments would be formed as an integral unit during manufacture. Moreover, the compartments need not be round as they may take various shapes depending on the number and arrangement of the vertical partitions. For example, if four vertical partitions were used forming right angles at the center of the cup, the result would be four separate compartments resembling the four quadrants of a circle as one would look down into the cup.

The aspirator tubes 16 and 17 as shown in FIG. 1 extend downwardly from a valve housing 18 and through a detachable lid 19 to enter only one respective compartment when the lid 19 is closed. For example, the illustrations in FIG.'S 1 and 2 show aspirator tube 17 bent slightly forward in the direction of the gun's nozzle to engage a diminishable level of paint as the volume decreases in compartment 15 as the gun and attached cup is tilted forward during use.

However, it should also be pointed out that in some industrial applications it would not be possible for the spray gun to be directly connected to a compartmentalized paint cup where the cup 11 might contain very large volumes of paint making it impossible for the operator to lift. In this type of situation FIG. 1 would have been broken apart vertically between the valve housing 18 and the lid 19 to illustrate lengths of at least two flexible hoses connecting the aspirator tubes 16 and 17 and extending to the valve housing 18 and spray gun at some remote location. This arrangement would easily accommodate a pressure fed spray gun.

Figure 2:
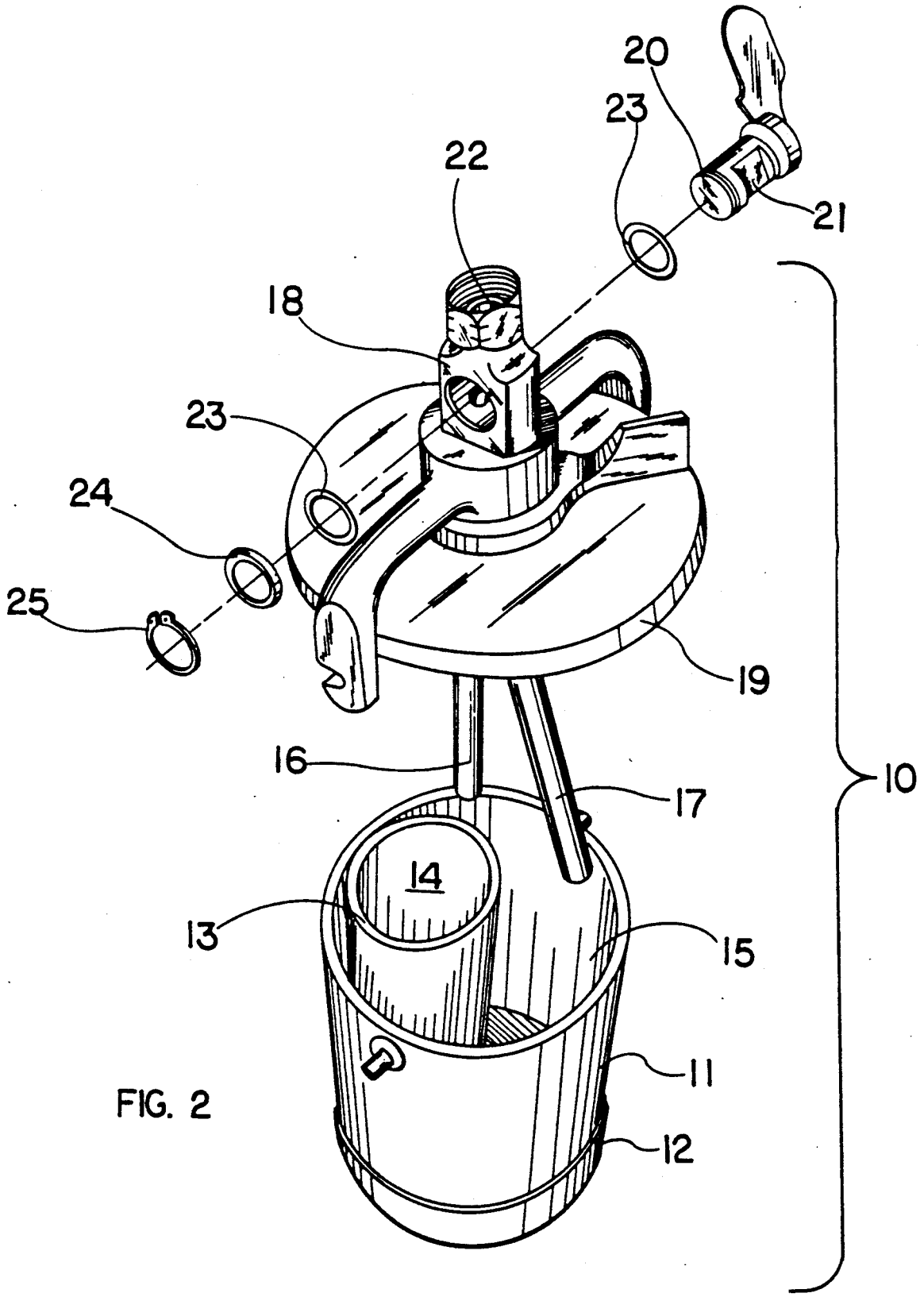
FIG. 2 is an exploded perspevtive view from the top.

Referring now to FIG. 2, there is illustrated a perspective view of my new invention 10 from the top with the selector valve 20 broken away and also exposing a portion of the valve housing 18 exterior. It is of course well known that there are numerous spool-type butterfly controlled diverter valves commercially available to selectively open only one passageway while closing others, and some valve spools have networks of passageways designed to close several branch passageways while opening only one at a time to a common outlet. Therefore, the particular valve shown as 20 in FIG. 2 is representative only of the preferred embodiment of my invention to accommodate only two aspirator tubes for a dual-compartmentalized paint cup and it should be obvious for one skilled in the art to substitude a multichannel valve spool to accommodate multiple aspirator tubes for a multi-chambered paint cup.

The selector valve 20 comprises a somewhat triangular gate 21 (see FIG. 4), the base of which may be shifted between alternate positions in the valve seat to selectively seal one end of an aspirator tube 16 as it enters the valve housing 18. Since the apex of the triangular gate 21 (FIG. 4) does not communicate with valve housing cavity, the passageway from aspirator tube 17 to a commom outlet 22 is open. When the valve spool is axially rotated to its opposite position, the base of the triangular gate 21 seals aspirator tube 17 and opens 16 to the common outlet 22.

Figure 3:
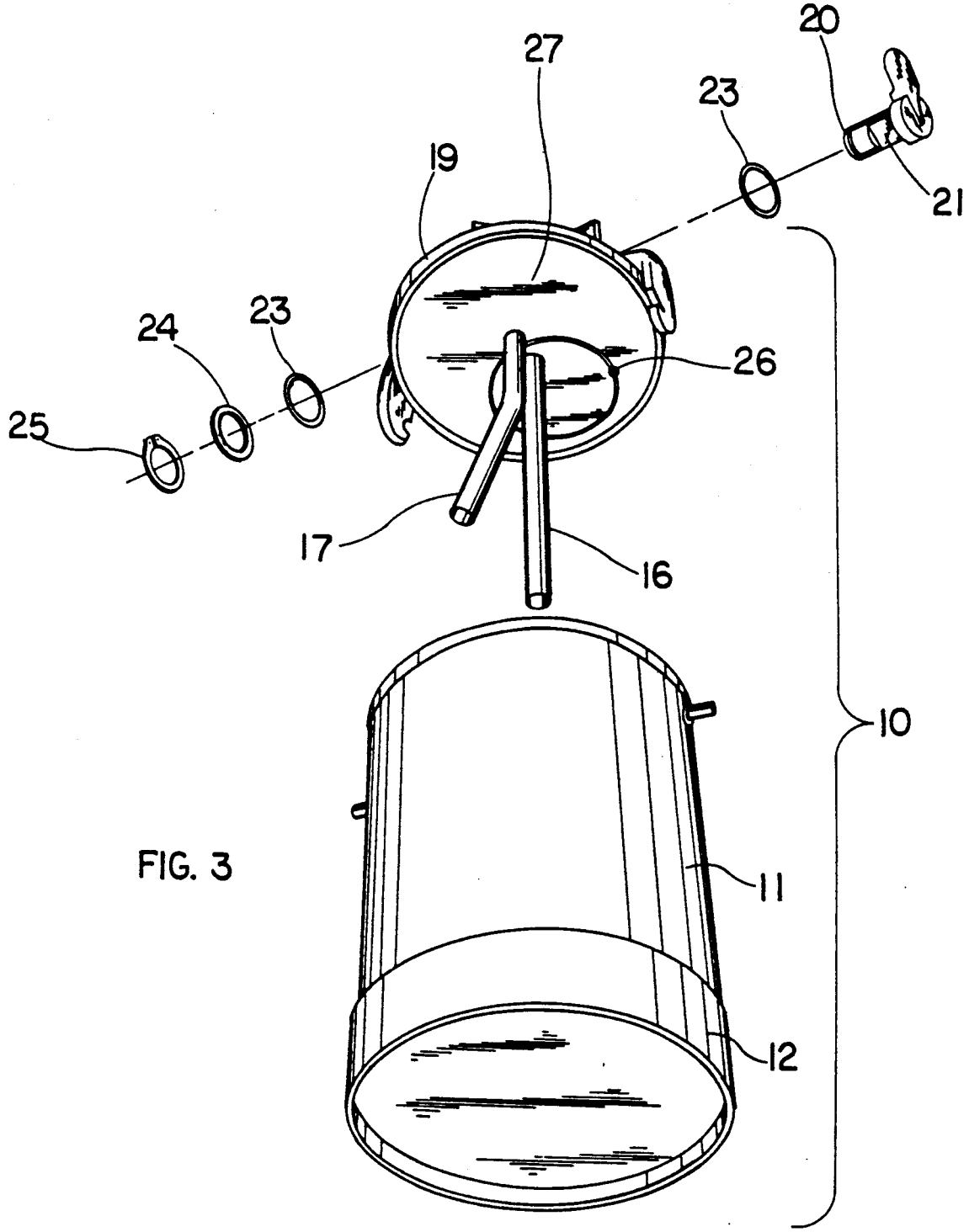
FIG. 3 is an exploded perspective view from the bottom.

The spool of the valve body 20 is removably retained in the valve housing 18 by a pair of resilient "O" rings 23, a washer 24, and a snap ring 25 to form an air tight seal. A single vent 26, as shown in FIG. 3, is an oblique hole through the top of the lid 19 which is satisfactory to allow atmospheric pressure to enter both compartments 14 and 15 of the dual compartmentalized paint cup because the vent is positioned above the junction of said compartments when the lid is closed. However, additional vents would be required for paint cups containing more than two compartments, and for pressure fed spray gun operations said vents would be threaded to received connecstors for pressurized air lines for pressurization of all internal compartments of said cup from an external source such as an air compressor.

FIG. 3 illustrates another view of my new invention broken away and ciewed from the bottom. Here it is seen that the aspirator tubes 16 and 17 enter the lid 19 at its proximate center through a single gasket 27 of sufficient size and shape to form an air tight closure around the rim of each particular compartment to prevent mixing of materials in the cup. In this regard it is also important that the vent hole 26 extend through the gasket 27 and be positioned directly over a vertical partition between said compartments when the lid is closed.

Figure 4:
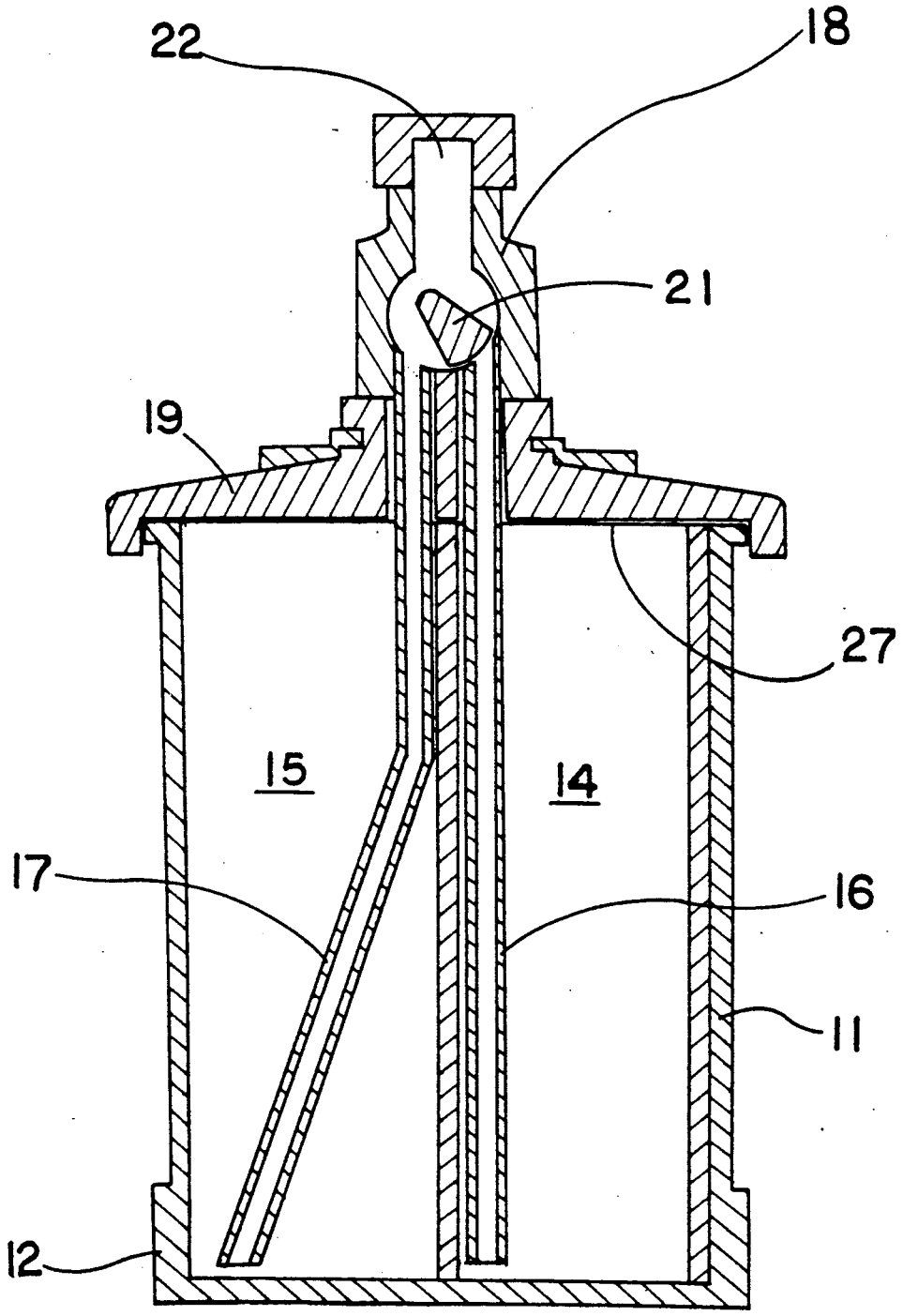
FIG. 4 is a vertical cross sectional view of the compartmentalized paint cup and selector valve assembly with lid attached.

FIG. 4 is a cross-sectional view of my present invention taken essentially through its center. In this view it can be seen that the aspirator tubes 14 and 15 extend through the lid 19 into the valve housing 18 where an essentially triangular gate 21 of the valve spool may be rotated between alternate positions to selectively block the fluid flow from one aspirator while permitting fluid flow from the other aspirator to a common passageway 22.

While my invention has been described in a preferred embodiment and with specific illustrations, it should be understood that various modifications of my invention will undoubtedly occur without departing from the spirit and scope of the following calims.

I claim:

1. For use in combination with a conventional or automated hand-held spray gun:

A. a detachable paint cup comprising at least two vertical compartments for containing a different liquid coating material in each said compartment for spray application;

B. a detachable lid to cover said compartmentalized paint cup to form an air tight seal over each separate compartment in said cup when the lid is closed, said lid further comprising:

1. at least two vertical aspirator tubes projecting downwardly through the proximate center of said lid causing each tube to extend nearly to the bottom of one compartment, the forward tube being slightly bent forward towards the direction forward of said spray gun to contact a minimal level of liquid as the cup is tilted forward;
2. vent means providing an air passageway to each of the said compartments;
3. a valve housing permanently attached at the top of said lid for receiving each aspirator tube and further comprising a rotatable valve spool with an essentially triangular gate means to selectively permit fluid flow from a single aspirator tube through a common passageway into an attached spray gun.

* * * * *